US007375707B1

(12) United States Patent
Lee

(10) Patent No.: US 7,375,707 B1
(45) Date of Patent: May 20, 2008

(54) APPARATUS AND METHOD FOR COMPENSATING GAMMA VOLTAGE OF LIQUID CRYSTAL DISPLAY

(75) Inventor: Sang Tae Lee, Kumi-shi (KR)

(73) Assignee: LG.Philips LCD Co., Ltd., Seoul (KR)

( * ) Notice: Subject to any disclaimer, the term of this patent is extended or adjusted under 35 U.S.C. 154(b) by 224 days.

(21) Appl. No.: 09/655,389

(22) Filed: Sep. 5, 2000

(30) Foreign Application Priority Data

Sep. 7, 1999 (KR) ..... 1999-37971

(51) Int. Cl.
*G09G 3/36* (2006.01)

(52) U.S. Cl. ..... 345/89; 345/94

(58) Field of Classification Search ..... 345/204, 345/690, 87–111, 208, 53
See application file for complete search history.

(56) References Cited

U.S. PATENT DOCUMENTS 5,043,821 A * 8/1991 Suga et al. ..... 358/213
5,214,417 A * 5/1993 Yamazaki ..... 345/210
5,365,250 A * 11/1994 Hirashima ..... 345/94
6,266,039 B1 * 7/2001 Aoki ..... 345/94
6,275,207 B1 * 8/2001 Nitta et al. ..... 345/89
6,289,139 B1 * 9/2001 Chen et al. ..... 382/312
6,356,253 B2 * 3/2002 Uchino et al. ..... 345/89

FOREIGN PATENT DOCUMENTS

JP 08-76083 3/1996

* cited by examiner

*Primary Examiner*—Sumati Lefkowitz
*Assistant Examiner*—Srilakshmi K Kumar
(74) *Attorney, Agent, or Firm*—McKenna Long & Aldridge, LLP

(57) ABSTRACT

A gamma voltage compensating apparatus and method for a liquid crystal display wherein a gamma voltage is compensated to improve a charge characteristic of a pixel. In the apparatus, a pre-charge voltage generator generates a pre-charge voltage allowing a gamma voltage to be higher than a target voltage in a certain time interval every one horizontal period. A gamma voltage generator adds the pre-charge voltage from the pre-charge voltage generating means to a predetermined reference voltage in such a manner to have a different level in accordance with a voltage level of an image signal, thereby generating a gamma voltage. Accordingly, a gamma voltage including a pre-charge voltage higher than the target gamma voltage is applied to improve a charge characteristic of the pixel, thereby preventing a charged voltage difference from being generated between the horizontal and vertical pixels.

17 Claims, 10 Drawing Sheets

APPARATUS AND METHOD FOR COMPENSATING GAMMA VOLTAGE OF LIQUID CRYSTAL DISPLAY

BACKGROUND OF THE INVENTION

1. Field of the Invention

This invention relates to a liquid crystal display device, and more particularly to a gamma voltage compensating apparatus and method wherein a gamma voltage is compensated to improve a charge characteristic of a pixel.

2. Description of the Related Art

Generally, a liquid crystal display (LCD) controls a light transmissivity of liquid crystal in accordance with an image signal to display a picture. Such a LCD has a gamma characteristic that changes the gray scale of a picture linearly rather than non-linearly in accordance with a voltage level of an image signal. This is caused by the fact that the light transmissivity of a liquid crystal is not changed linearly in accordance with an image signal and the gray scale of a picture is not changed in accordance with the light transmissivity of a liquid crystal. In order to prevent a deterioration of a picture caused by such a gamma characteristic, an interval between voltage level of an image signal is changed with the aid of a gamma compensation voltage. In other words, the LCD adds a preset gamma voltage to a voltage level of an image signal as an offset voltage to have a different level in accordance with a voltage level of an image signal, thereby compensating the gamma characteristic.

To this end, as shown in FIG. 1, the LCD includes a picture display part 2 having liquid crystal cells arranged in a matrix type, a gate driver 4 for driving gate lines GL1 to GLm of the picture display part 2, a data driver 6 for driving data lines DL1 to DLn of the picture display part 2, and a gamma voltage generator 8 for applying a gamma voltage to the data driver 6. The picture display part 2 includes liquid crystal cells arranged in a matrix pattern, and switching devices (i.e., thin film transistors) provided at each intersection between the m gate lines GL1 to GLm and the n data lines DL1 to DLn to switch data signals applied to the liquid crystal cells. The gate driver 4 applies gate signals to the gate lines GL1 to GLm sequentially to drive the thin film transistors connected to the corresponding gate lines. The data driver 6 is synchronized with the gate signal to apply a pixel signal for one horizontal line to the data lines DL1 to DLn. In this case, the gamma voltage generator applies a preset direct current (DC) voltage to the data driver 6 as a gamma voltage in such a manner to have a different level in a voltage level of an image signal. Thus, the data driver 6 adds the gamma voltage from the gamma voltage generator 8 to a pixel signal and applies the same to the data lines, thereby compensating a gamma characteristic in the LCD.

FIGS. 2A and 2B represents electrical equivalent circuits of the gamma voltage generator. As shown in FIGS. 2A-B, the conventional gamma voltage generator includes a positive polarity part 10 for generating positive(+) gamma voltages VH1 to VH5 as shown in FIG. 2A, and a negative polarity part 12 for generating negative(−) gamma voltages VL1 to VL5 as shown in FIG. 2B, so as to generate a gamma voltage having the polarity inverted every one horizontal period 1Hs as shown in FIG. 3. The positive polarity part 10 voltage-divides a supply voltage VAA1 applied from the exterior thereof in accordance with a resistance ratio of first to sixth resistors R1 to R6 connected in series to generate the first to fifth positive gamma compensation voltages VH1 to VH5 at each of five nodes. Herein, the first positive gamma voltage VH1 has a voltage level corresponding to a black level, the third positive gamma voltage VH3 has a middle voltage level, and the fifth positive gamma voltage VH5 has a voltage level corresponding to a white level. In other words, a voltage level is more reduced as it goes from the first positive gamma voltage VH1 to the fifth positive gamma voltage VH5. Similarly, the negative polarity part 12 voltage-divides a supply voltage VAA2 applied to an input terminal as opposed to the positive polarity part 10 in accordance with a resistance ratio of the first to sixth resistors R1 to R6 to generate the first to fifth negative gamma voltages VL1 to VL5 at each of five nodes. Herein, the first negative gamma voltage VL1 has a voltage level the third corresponding to a black level, negative gamma voltage VL3 has a middle voltage level, and the fifth negative gamma voltage VL5 has a voltage level corresponding to a white level. In other words, a voltage level is more increased as it goes from the first negative gamma voltage VL1 into the fifth negative gamma voltage VL5.

In such a gamma voltage generator 8 including the positive polarity part 10 and the negative polarity part 12, a gamma voltage Vr is generated at an opposite polarity every one horizontal period 1Hs and is outputted, via the data driver 6, to the corresponding data lines DL1 to DLn. Each data line DL1 to DLn in the picture display part 2 includes a resistance component R and a capacitance component C. Voltage signals applied to the data lines DL1 to DLn have a delay line characteristic by a time constant RC from the resistance component R and the capacitance component of the data lines DL1 to DLn. Particularly, since the resistance component R and the capacitance component C are different depending on a vertical position at a certain data line, the delay line characteristic becomes different. Due to the different delay line characteristic depending on a vertical position at the data line, the rise time of an applied voltage becomes different in accordance with the vertical position even when gamma voltages having the same level are applied to the data lines. More specifically, at a position close to the data driver 6 (e.g., the upper side of the picture display part) in a certain data line, a rise time RT1 of an applied gamma voltage Vdh is relatively short as shown in FIG. 4B because the time constant RC is small. When a rise time RT1 of the gamma voltage Vdh is short, a voltage Vcp1 charged in a pixel arrives at and maintains a target voltage within a faster time (e.g., within one horizontal period). On the other hand, at a position distant from the data driver 6 (e.g., the lower side of the picture display part), a rise time RT2 of an applied gamma voltage Vd1 is relatively long because the time constant RC became large due to an increase in the resistance component R and the capacitance component C. When a rise time RT2 of the gamma voltage Vd1 is long, it becomes impossible to charge a target voltage in a pixel within a given one horizontal period because a time charging a voltage in the pixel is delayed, so that a pixel charging voltage Vcp2 has a smaller level than the target voltage. For this reason, a voltage difference is generated between pixels at the vertical direction to which the same level of gamma voltages are applied in response to an identical pixel signal. As a result, a vertical brightness difference is generated between pixels intended to display the same brightness level, thereby causing deterioration of a picture quality.

Furthermore, each output resistance at output pins of the data driver 6 is different so, voltage signals applied to each data line DL1 to DLn have a different delay line characteristic. More specifically, when an output resistance at a specific output pin (e.g., the 128th output pin) of the data driver 6 is small, a rise time RT1 of the gamma voltage Vdh applied to the corresponding data line is relatively short as shown in FIG. 4B. When a rise time RT1 of the gamma voltage Vdh is short, a voltage Vcp1 charged in a pixel arrives at and maintains a target voltage within a faster time (e.g., within one horizontal period). On the other hand, when an output resistance at other specific output pin (e.g., the 129th output pin) is large, a rise time RT2 of the gamma voltage Vd1 applied to the corresponding data line is relatively long as shown in FIG. 4A. When a rise time RT2 of the gamma voltage Vd1 is long, it becomes impossible to charge a target voltage in a pixel within a given one horizontal period because a time charging a voltage in the pixel is delayed, so that a pixel charging voltage Vcp2 has a smaller level than the target voltage. For this reason, a voltage difference is generated between pixels in the horizontal direction to which the same level of gamma voltages are applied in response to an identical pixel signal. As a result, a horizontal brightness difference is generated between pixels intended to display the same brightness level, thereby causing deterioration of a picture quality.

In particular, as the LCD tends toward a higher resolution and a larger screen to increase the number of pixels, a voltage charging interval of the pixel is more shortened. Also, as a load of the data line gets larger, a charging characteristic of the pixel is more deteriorated. As a result, a poor picture quality related to the charging characteristic of the pixel accompanies.

Accordingly, it is an object of the present invention to provide a gamma voltage compensating apparatus and method wherein a gamma voltage includes a per-charge voltage higher than a target gamma voltage to prevent the generation of a charged voltage difference between horizontal and vertical pixels.

In order to achieve these and other objects of the invention, a gamma voltage compensating apparatus for a liquid crystal display according to one aspect of the present invention includes pre-charge voltage generating means for generating a pre-charge voltage allowing a gamma voltage to be higher than a target voltage in a certain time interval every one horizontal period; and gamma voltage generating means for adding the pre-charge voltage from the pre-charge voltage generating means to a predetermined reference voltage in such a manner to have a different level in accordance with a voltage level of an image signal, thereby generating a gamma voltage.

A gamma voltage compensating method for a liquid crystal display according to another aspect of the present invention includes the steps of generating a pre-charge voltage allowing a gamma voltage to be higher than a target voltage in a certain time interval every one horizontal period; and adding the pre-charge voltage from the pre-charge voltage generating means to a predetermined reference voltage in such a manner to have a different level in accordance with a voltage level of an image signal, thereby generating a gamma voltage.

BRIEF DESCRIPTION OF THE DRAWINGS

These and other objects of the invention will be apparent from the following detailed description of the embodiments of the present invention with reference to the accompanying drawings, in which:

Referring to FIG. 5, there is shown a liquid crystal display according to an embodiment of the present invention. In comparison to the LCD shown in FIG. 1, the liquid crystal display (LCD) further includes a pre-charge generator 14 for applying a pre-charge voltage to a gamma voltage generator. Hereinafter, a detailed explanation as to the elements identical to those in FIG. 1 will be omitted.

Figure 6A:
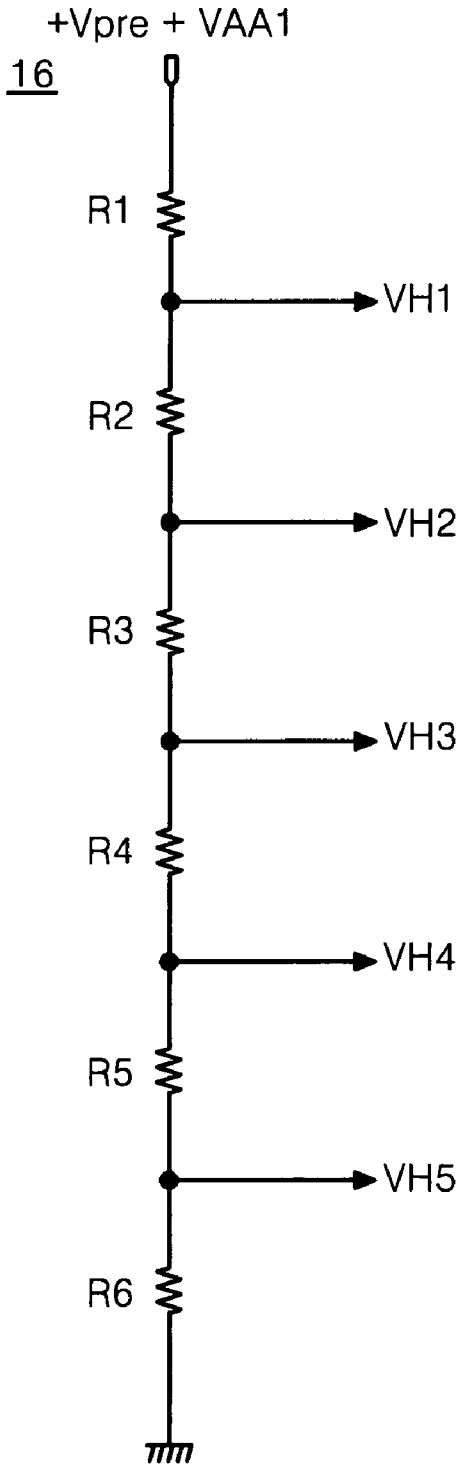
FIGS. 6A and 6B are equivalent circuit diagrams of a positive part and a negative part of the gamma voltage generator in FIG. 5, respectively.
Figure 6B:
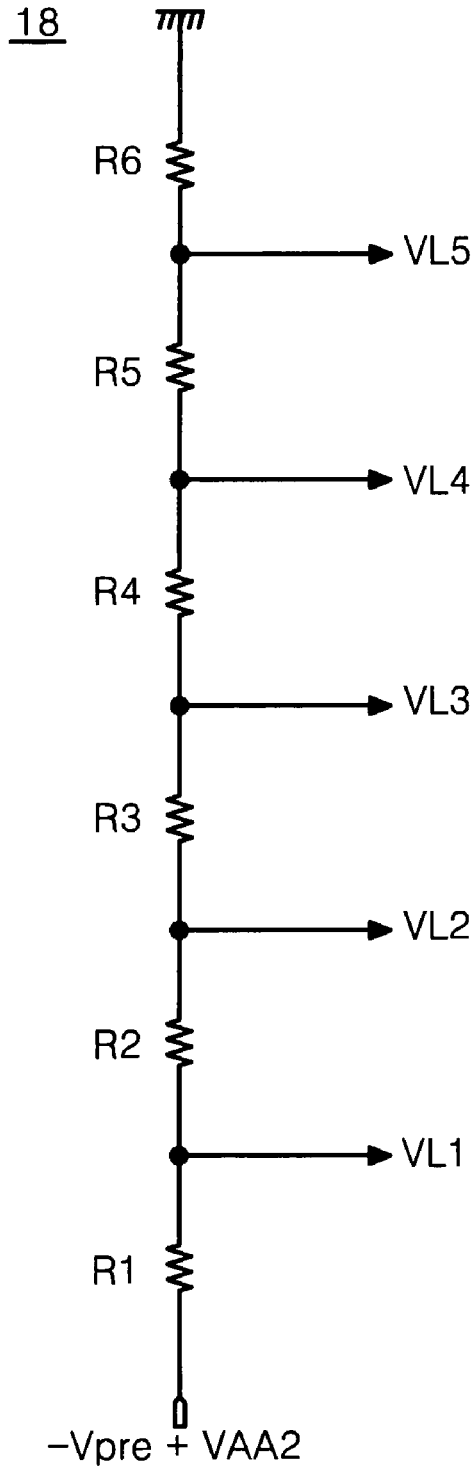
Figure 7:
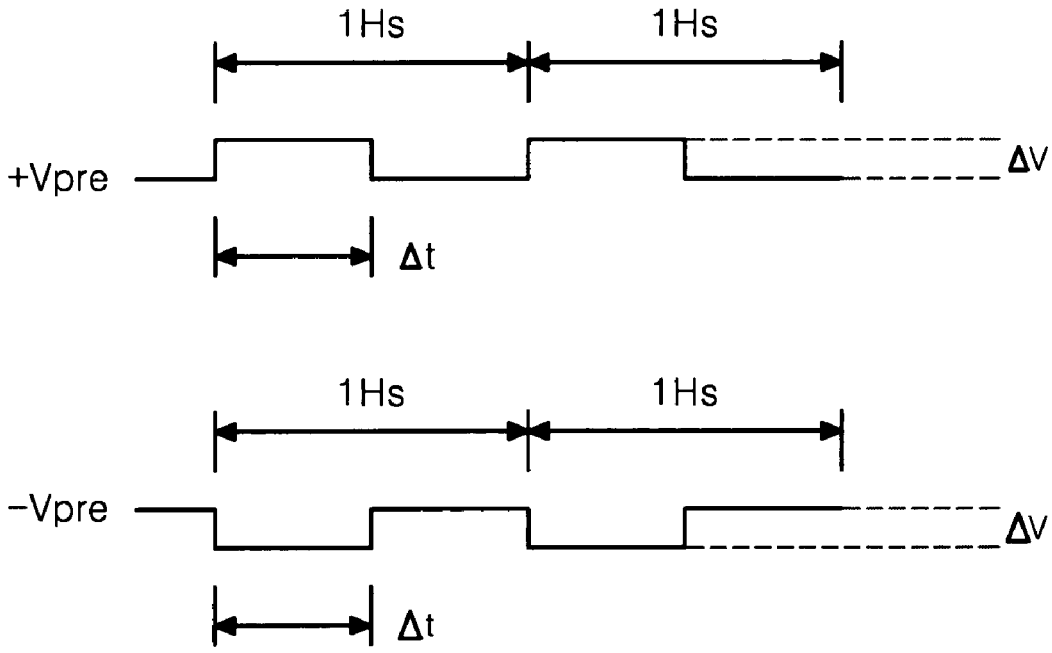
FIG. 7 is waveform diagrams of positive and negative pre-charge voltages outputted from the pre-charge voltage generator shown in FIG. 5.
Figure 8:
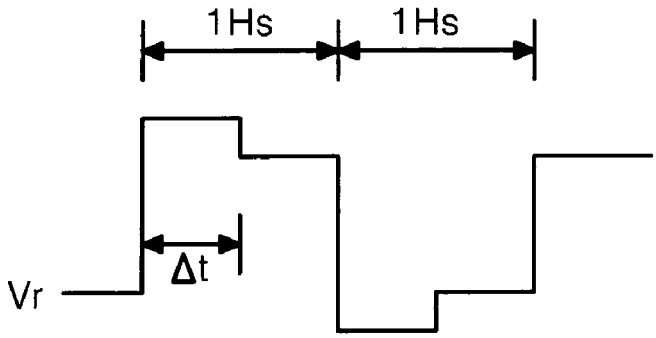
FIG. 8 is a waveform diagram of a gamma voltage outputted via the data driver shown in FIG. 5.

The pre-charge voltage generator 14 generates an alternating current (AC) pre-charge voltage signal to apply to the gamma voltage generator 8. The gamma voltage generator 8 receives the pre-charge voltage signal applied from the pre-charge voltage generator 14 and a supply voltage VAA applied from a power supply to generate a gamma voltage having a different voltage in accordance with a voltage level of an image signal. More specifically, the gamma voltage generator 8 consists of a positive polarity part 16 and a negative polarity part 18 for generating a positive gamma voltage and a negative gamma voltage as shown in FIG. 6A and FIG. 6B, respectively. The positive polarity part 16 receives a pre-charge voltage signal +Vpre, via an input terminal, from the pre-charge voltage generator 14. In this case, the pre-charge voltage signal +Vpre has a rectangular waveform maintaining a state of positive(+) pre-charge voltage ΔV only during a certain pre-charge interval Δt within one horizontal period as shown in FIG. 7. Herein, the pre-charge interval, Δt and the pre-charge voltage ΔV are variable depending on a characteristic of the LCD. The positive polarity part 16 voltage-divides such a pre-charge voltage signal +Vpre by first to sixth resistors R1 to R6 connected in series to output first to fifth positive gamma voltages VH1 to VH5, via each of five nodes, to a data driver 6. The negative polarity part 18 receives a negative pre-charge voltage −Vpre, via an input terminal, from the pre-charge voltage generator 14. In this case, the pre-charge voltage signal −Vpre applied to the negative polarity part 18 has a rectangular waveform maintaining a state of negative (−) pre-charge voltage ΔV only during a certain pre-charge interval Δt within one horizontal period as shown in FIG. 7. Herein, the pre-charge interval Δt and the pre-charge voltage ΔV are variable depending on a characteristic of the LCD. The negative polarity part 18 voltage-divides such a pre-charge voltage signal −Vpre by first to sixth resistors R1 to R6 connected in series to output first to fifth negative gamma voltages VL1 to VL5, via each of five nodes, to a data driver 6.

Figure 9A:
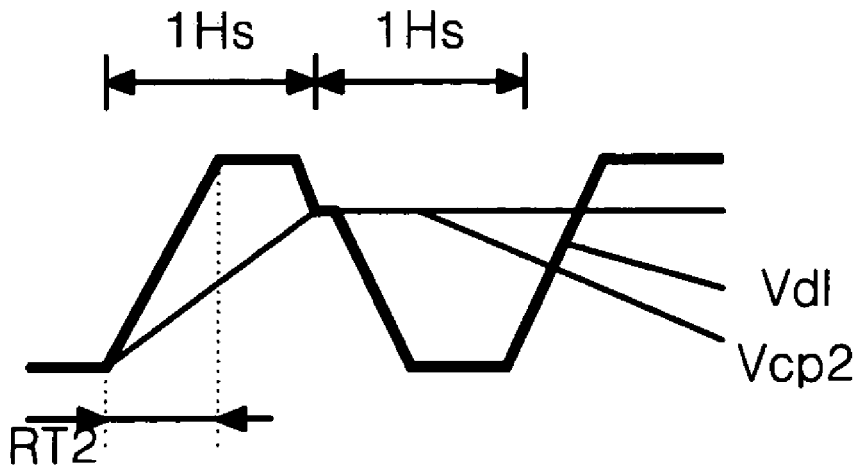
FIGS. 9A and 9B are waveform diagrams of a voltage in the data line and a pixel charging voltage, respectively.

Accordingly, a gamma voltage Vr outputted via the data driver 6 has such a shape that a rectangular waveform having a two-step voltage level is inverted every one horizontal period 1Hs as shown in Fig. B. In other words, a gamma voltage Vr applied to the data line has a higher level than a target voltage in the pre-charge interval Δt and a two-step rectangular waveform having the target voltage in the next interval. As the pre-charge voltage higher than the target voltage is first applied and then the target voltage is applied in this manner, a voltage charged in the pixel can be approximated to the target voltage in spite of a difference in a delay characteristic according to a vertical position in a certain data line or every data line as shown in FIG. 9A and FIG. 9B.

Figure 9B:
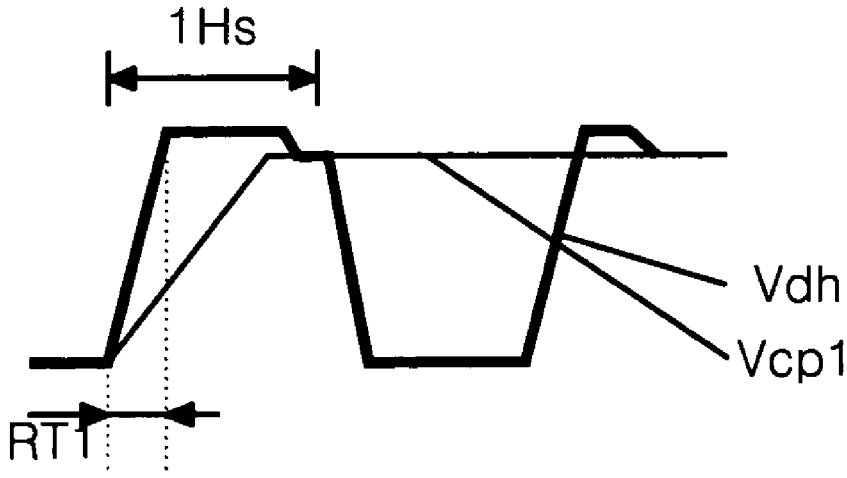

More specifically, at a position close to the data driver 6 (e.g., the upper side of the picture display part) in a certain data line, a rise time RT1 of an applied gamma voltage Vdh is relatively short as shown in FIG. 9B because the time constant RC is small. When a rise time RT1 of the gamma voltage Vdh is short, a voltage charged in a pixel arrives at and maintains the target voltage within a faster time (e.g., within one horizontal period) by virtue of the pre-charge voltage being higher than the target voltage. On the other hand, at a position distant from the data driver 6 (e.g., the lower side of the picture display part), a rise time RT2 of an applied gamma voltage Vd1 is relatively long as shown in FIG. 9A because the time constant RD became large due to an increase in a resistance component R and a capacitance component C. Even when the rise time RT2 of the gamma voltage Vd1 is long, a voltage charged in the pixel can arrive at and maintain the target voltage within one horizontal period by virtue of the pre-charge voltage being higher than the target voltage. As a result, since pixels in the vertical direction supplied with a voltage having the same level charge to the same target voltage irrespective of a delay line characteristic different in accordance with a vertical position of the data line, a brightness difference in the vertical direction in the prior art is not generated.

Furthermore, when an output resistance at a specific output pin (e.g., the 128th output pin) of the data driver 6 is small, a rise time RT1 of the gamma voltage Vdh applied to the corresponding data line is relatively short as shown in FIG. 9B. When a rise time RT1 of the gamma voltage Vdh is short, a voltage Vcp1 charged in a pixel arrives at and maintains a target voltage within a faster time (e.g., within one horizontal period). On the other hand, when an output resistance at another specific output pin (e.g., the 129th output pin) is large, a rise time RT2 of the gamma voltage Vd1 applied to the corresponding data line is relatively long as shown in FIG. 9A. Even when the rise time RT2 of the gamma voltage Vd1 is long, a voltage charged in the pixel can arrive at and maintain the target voltage within one horizontal period by virtue of the pre-charge voltage being higher than the target voltage. As a result, since pixels in the horizontal direction supplied with a voltage having the same level charge to the same target voltage irrespective of a delay line characteristic being different in accordance with a horizontal position of the data line, a brightness difference in the horizontal direction in the prior art is not generated.

Figure 1:
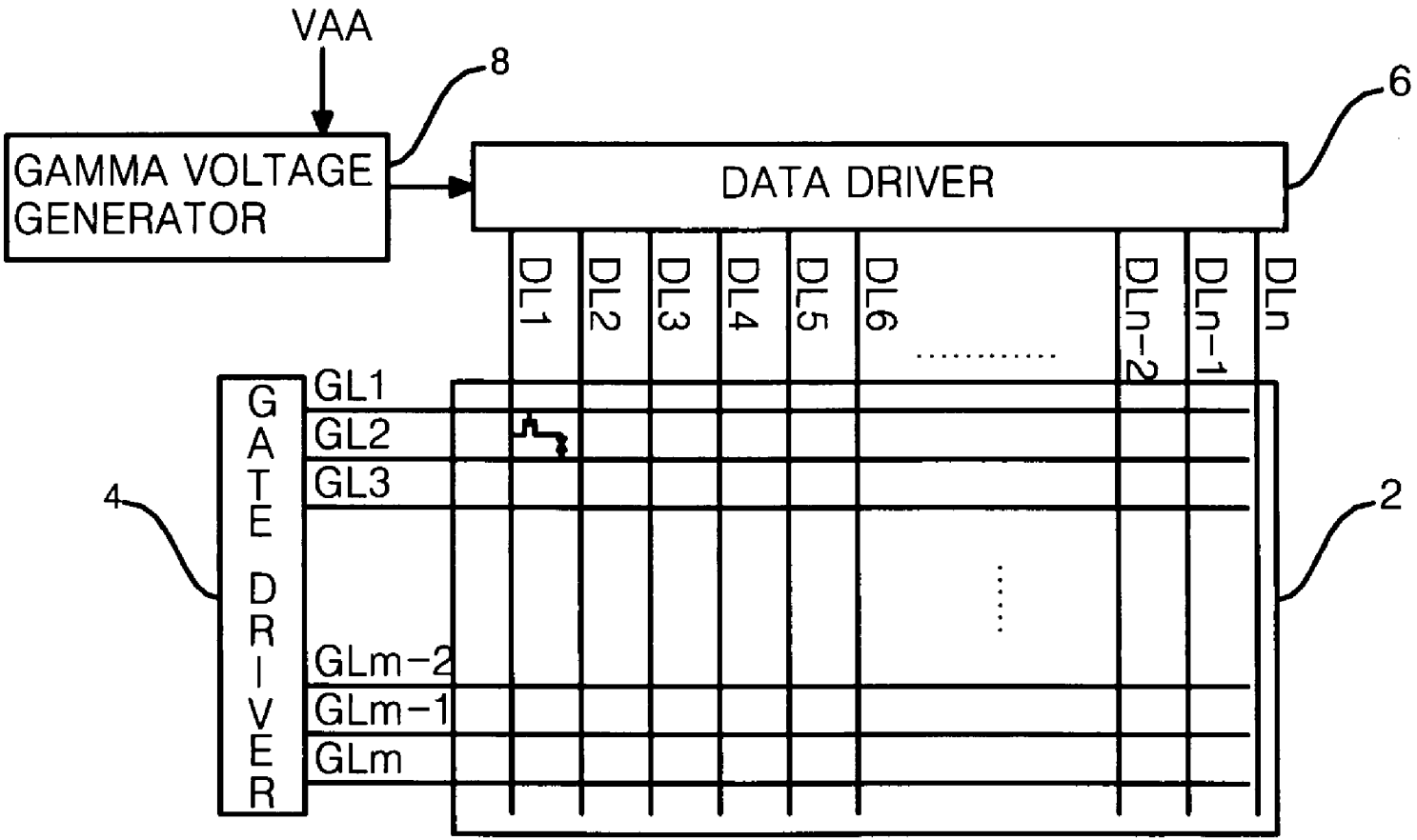
FIG.1 PRIOR ART
FIG. 1 is a block diagram showing a configuration of a conventional liquid crystal display.
Figure 2A:
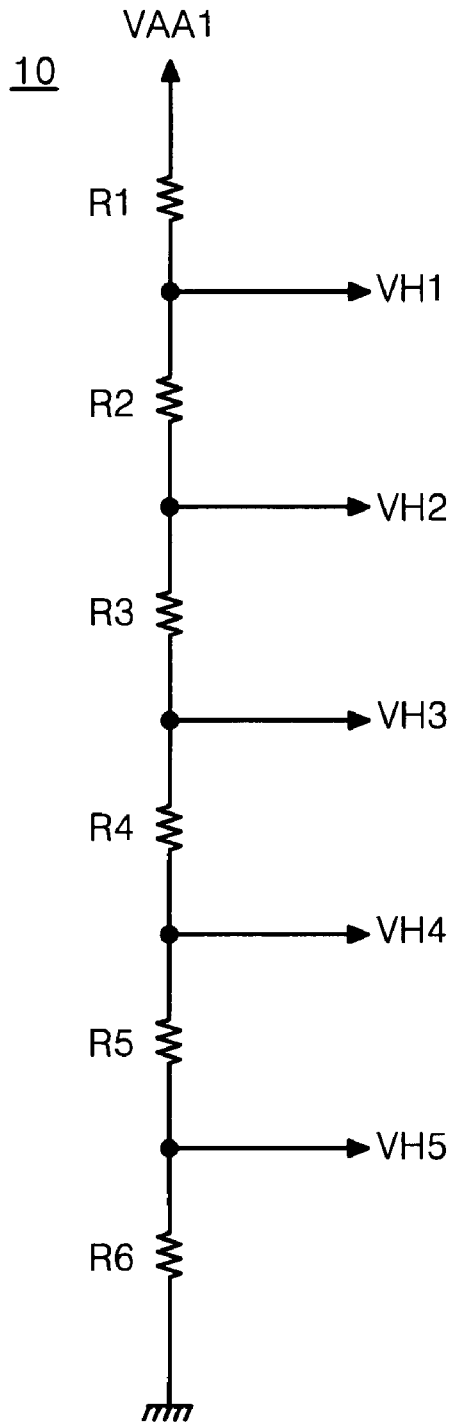
FIG.2A PRIOR ART
FIGS. 2A and 2B are equivalent circuit diagrams of a positive part and a negative part of the gamma voltage generator in FIG. 1, respectively.
Figure 2B:
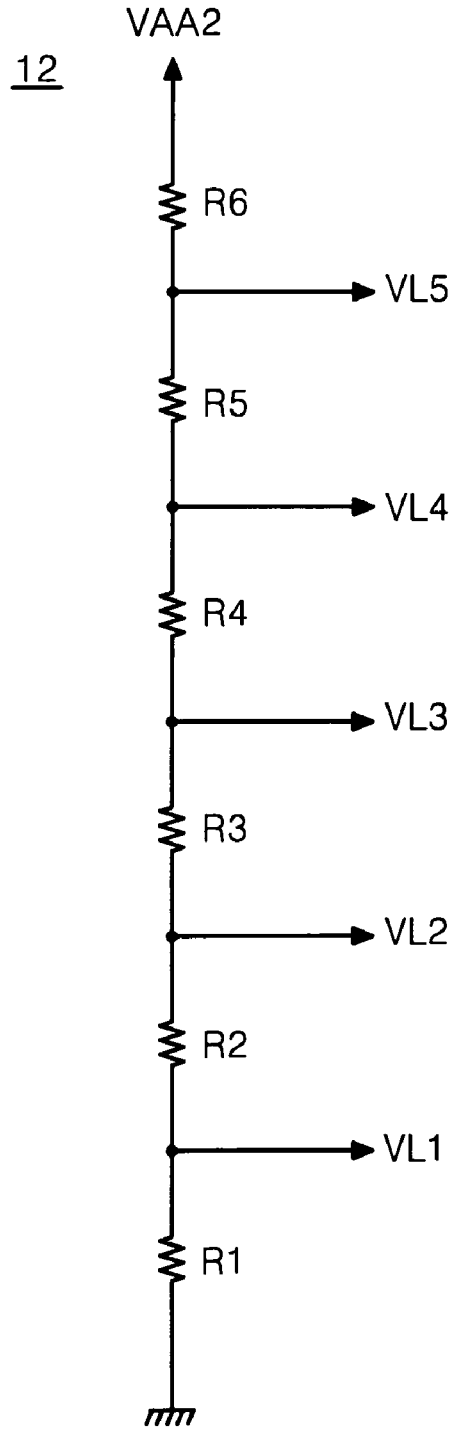
FIG.2B PRIOR ART
Figure 3:
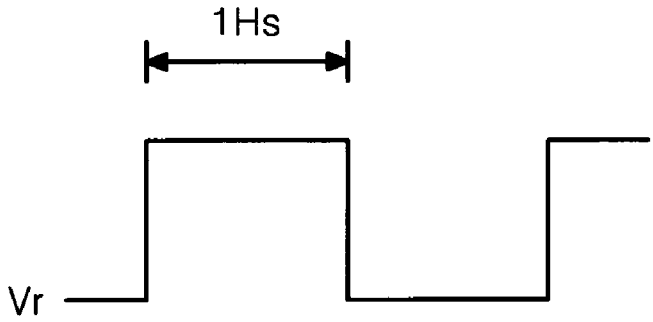
FIG.3 PRIOR ART
FIG. 3 is a waveform diagram of a gamma voltage outputted via the data driver shown in FIG. 1.
Figure 4A:
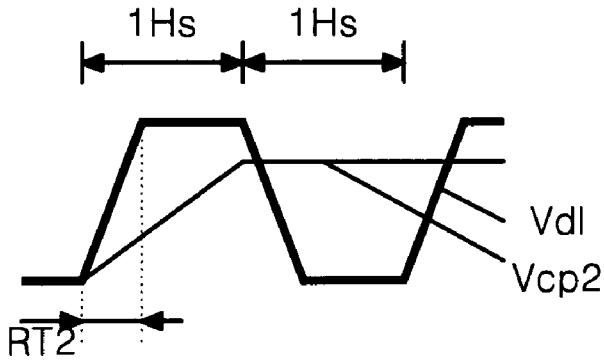
FIG.4A PRIOR ART
FIGS. 4A and 4B are waveform diagrams of a voltage in the data line and a pixel charging voltage, respectively.
Figure 4B:
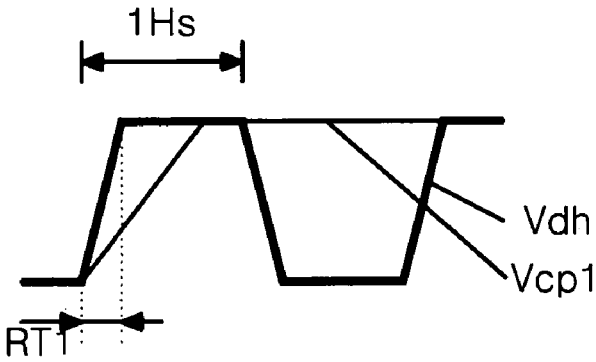
FIG.4B PRIOR ART
Figure 5:
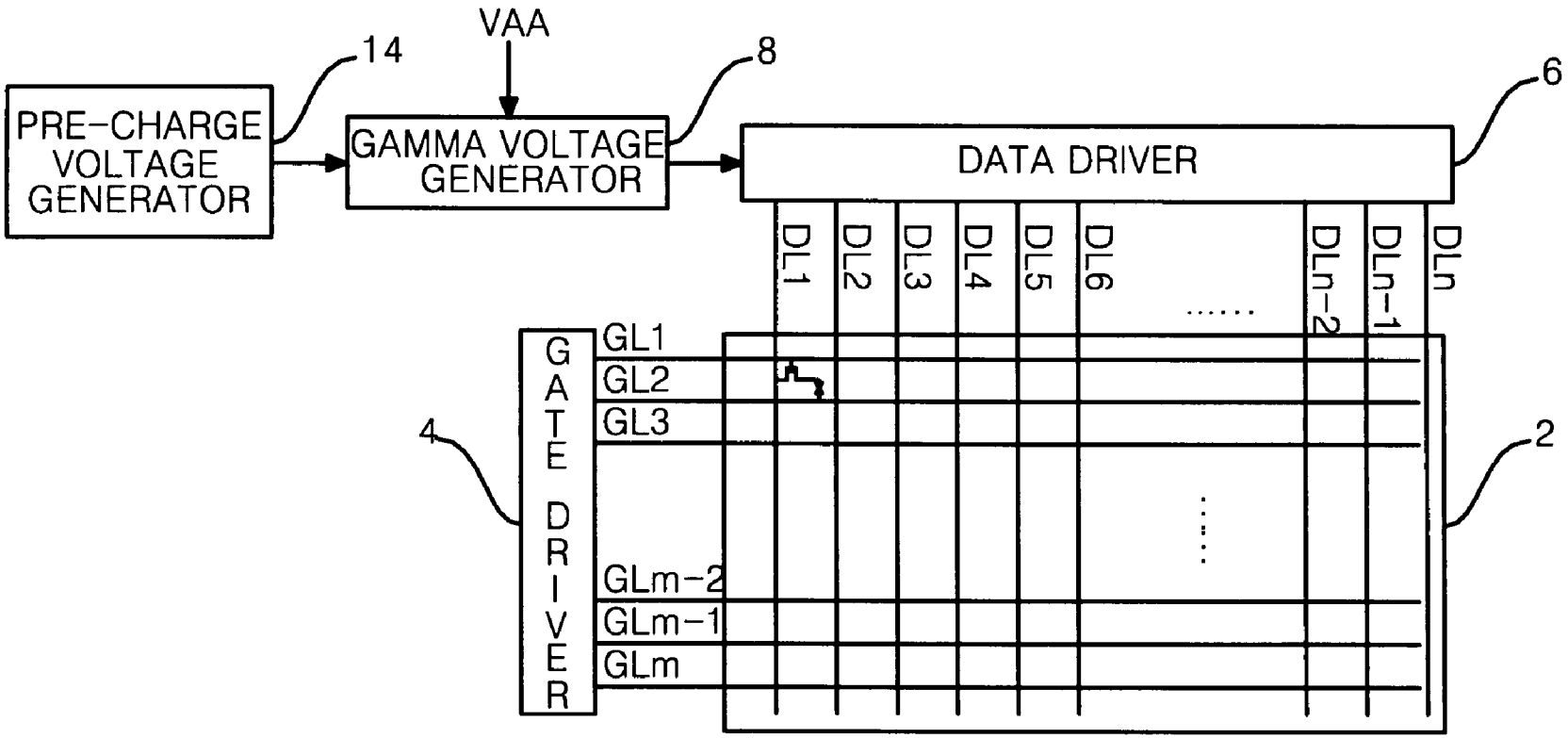
FIG. 5 is a block diagram showing a configuration of a liquid crystal display according to an embodiment of the present invention.
Figure 10:
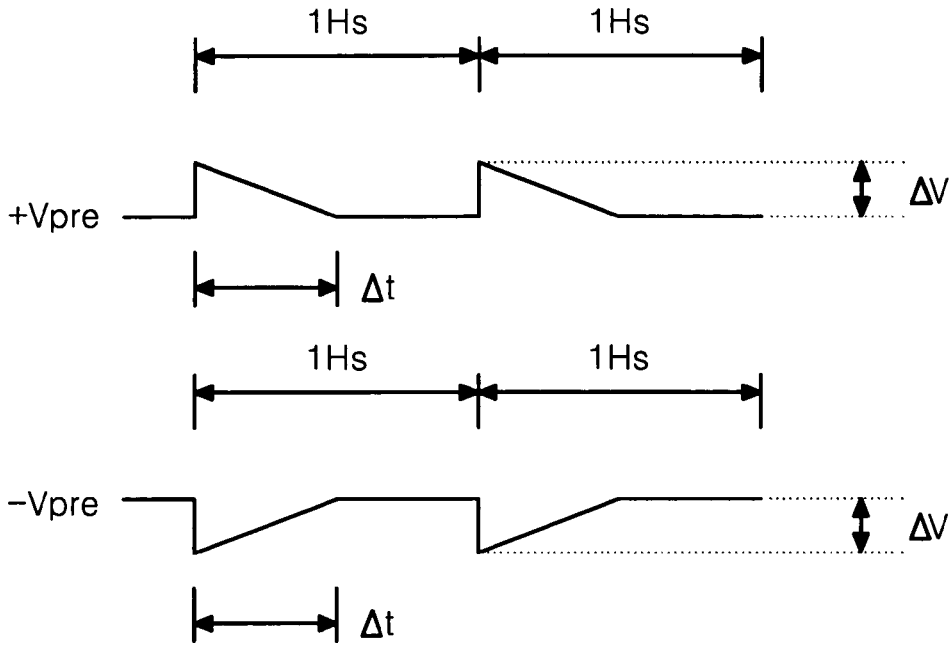
FIG. 10 illustrates other waveforms of positive and negative pre-charge voltages outputted from the pre-charge voltage generator shown in FIG. 5.
Figure 11:
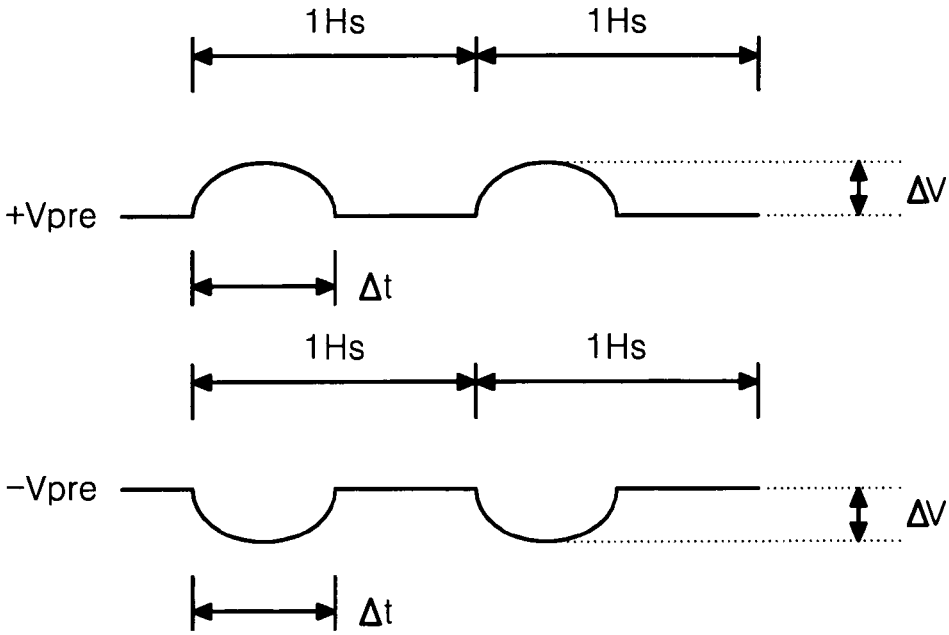
FIG. 11 illustrates yet other waveforms of positive and negative pre-charge voltages outputted from the pre-charge voltage generator shown in FIG. 5.

Referring now to FIG. 10 and FIG. 11, there are shown other embodiments of the pre-charge voltage signals +Vpre and −Vpre generated from the pre-charge voltage generator 14 shown in FIG. 5. Since a gamma voltage is applied at a higher level than the target voltage in the pre-charge interval Δt even when a pre-charge voltage ΔV having a saw-tooth waveform or a sine waveform as shown in FIG. 10 and FIG. 11, respectively, is added to the gamma voltage, the same target voltage can be charged irrespective of a delay line characteristic being different in accordance with a vertical position of the data line.

Alternatively, it is possible to apply the pre-charge voltage signals +Vpre and −Vpre having a rectangular waveform, a saw-tooth waveform and a sine waveform shown in FIG. 7, FIG. 10 and FIG. 11, respectively only to a gamma voltage corresponding to a middle gray scale voltage level rather than to a gamma voltage having all the voltage levels.

As described above, according to the present invention, a gamma voltage including a pre-charge voltage higher than the target gamma voltage is applied to improve a charge characteristic of the pixel, thereby preventing a charged voltage difference from being generated between the horizontal and vertical pixels. Accordingly, the horizontal and vertical brightness difference in the prior art is not generated between the pixels intended to display the same brightness level, so that a picture quality can be improved. Furthermore, even when a voltage charging interval in the pixel becomes short and a load of the data line becomes large as the LCD trends toward a high resolution and a large screen to increase the number of pixels, a charge characteristic of the pixel can be good to obtain an excellent picture quality.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. A gamma voltage compensating apparatus for a liquid crystal display, comprising:

a power supply for generating a predetermined reference voltage;

pre-charge voltage generating means for generating a pre-charge voltage; and gamma voltage generating means connected to the power supply and the pre-charge voltage generating means for adding the pre-charge voltage to the predetermined reference voltage to generate a gamma voltage having a voltage level corresponding to an image signal to be supplied to a data line of the liquid crystal display, wherein the gamma voltage has at least first and second voltage levels in one horizontal period, and the first voltage level is greater than the second voltage level.

2. The gamma voltage compensating apparatus according to claim 1, wherein the pre-charge voltage generating means generates a pre-charge voltage having any one of a rectangular waveform, a saw-tooth waveform and a sine waveform.

3. A method of compensating a gamma voltage in a liquid crystal display, comprising:

supplying a predetermined reference voltage;

generating a pre-charge voltage; and adding the pre-charge voltage to the predetermined reference voltage to generate a gamma voltage having a voltage level corresponding to an image signal to be supplied to a data line of the liquid crystal display, wherein the gamma voltage has at least first and second voltage levels in one horizontal period, and the first voltage level is greater than the second voltage level.

4. The method according to claim 3, wherein said step of generating the pre-charge voltage includes generating a pre-charge voltage having any one of a rectangular waveform, a saw-tooth waveform and a sine waveform.

5. A compensated gamma voltage generating device for a liquid crystal display, comprising:

a power supply for generating a predetermined reference voltage;

a pre-charge voltage generator for generating a pre-charge voltage having a first pre-charge voltage level at a first time within a horizontal interval and a second pre-charge voltage level, different from the first pre-charge voltage level, at a second time within the horizontal interval; and a gamma voltage generator adding the pre-charge voltage to the predetermined voltage to generate a gamma voltage having a voltage level corresponding to an image signal to be supplied to a data line of the liquid crystal display, said gamma voltage having a first gamma voltage level at the first time within the horizontal interval and a second gamma voltage level, different from the first gamma voltage level, at the second time within the horizontal interval.

6. The compensated gamma voltage generating device of claim 5, wherein the gamma voltage generator comprises:

means for adding the pre-charge voltage to the predetermined reference voltage to produce a pre-charged gamma supply voltage; and a voltage divider for dividing the pre-charged gamma supply voltage to produce the gamma voltage.

7. The compensated gamma voltage generating device of claim 6, wherein the voltage divider comprises a resistor divider network.

8. The compensated gamma voltage generating device of claim 5, wherein the gamma voltage generator comprises:

a positive polarity part for generating positive gamma voltages during the horizontal interval; and a negative polarity part for generating negative gamma voltages during an immediately subsequent horizontal interval.

9. The compensated gamma voltage generating device of claim 5, wherein the pre-charge voltage has a waveform selected from a group consisting of a sawtooth waveform, a sine waveform, and a rectangular waveform.

10. The compensated gamma voltage generating device of claim 5, wherein the first time occurs within the horizontal interval before the second time, and wherein the magnitude of the first pre-charge voltage level is greater than the magnitude of the second pre-charge voltage level.

11. The compensated gamma voltage generating device of claim 5, wherein the pre-charge voltage has a positive polarity during at least a portion of the horizontal interval and has a negative polarity during at least a portion of an immediately subsequent horizontal interval.

12. A method of providing a compensated gamma voltage which is varied in accordance with a voltage level of an image signal, the method comprising:

generating a pre-charge voltage which has a first pre-charge voltage level at a first time within a horizontal interval and a second pre-charge voltage level different from the first pre-charge voltage level at a second time within the horizontal interval;

combining the pre-charge voltage with a supply voltage to produce the pre-charged gamma supply voltage; and dividing the pre-charged gamma supply voltage to produce the compensated gamma voltage, wherein the compensated gamma voltage has at least first and second voltage levels in one horizontal period, and the first voltage level is greater than the second voltage level.

13. The method of claim 12, wherein combining the pre-charge voltage with the supply voltage comprises adding the pre-charge voltage to the supply voltage.

14. The method of claim 12, wherein the pre-charge voltage has a waveform selected from a group consisting of a sawtooth waveform, a sine waveform, and a rectangular waveform.

15. A display device having a pixel, comprising:

a power supply for generating a predetermined reference voltage;

a pre-charge voltage generator for generating a pre-charge voltage;

a gamma voltage generator adding the pre-charge voltage to the predetermined reference voltage to generate a modulated gamma voltage, wherein the modulated gamma voltage has at least first and second voltage levels in one horizontal period, and the first voltage level is greater than the second voltage level; and a data driver applying the modulated gamma voltage to a data line of the display device.

16. The display device according to claim 15, wherein the first voltage level comes earlier than the second voltage level during the one horizontal period.

17. The display device according to claim 16, wherein the pre-charge voltage has any one of a rectangular waveform, a saw-tooth waveform and a sine waveform.

* * * * *